US008186776B2

(12) United States Patent
Zalewski

(10) Patent No.: US 8,186,776 B2
(45) Date of Patent: May 29, 2012

(54) STORAGE AND ORGANIZATION SYSTEM AND CONNECTIVITY OF THE COMPONENTS THEREIN

(75) Inventor: Kevin Zalewski, Rochester Hills, MI (US)

(73) Assignee: Target Brands, Inc., Minneapolis, MN (US)

( * ) Notice: Subject to any disclaimer, the term of this patent is extended or adjusted under 35 U.S.C. 154(b) by 292 days.

(21) Appl. No.: 12/554,034

(22) Filed: Sep. 4, 2009

(65) Prior Publication Data

US 2010/0237755 A1 Sep. 23, 2010

Related U.S. Application Data

(60) Provisional application No. 61/160,977, filed on Mar. 17, 2009, provisional application No. 61/161,019, filed on Mar. 17, 2009.

(51) Int. Cl.
*F16B 12/00* (2006.01)
*A47B 87/00* (2006.01)

(52) U.S. Cl. ..... 312/111; 312/107

(58) Field of Classification Search ..... 312/107, 312/108, 111, 257.1, 263, 265.5
See application file for complete search history.

(56) References Cited

U.S. PATENT DOCUMENTS

| | | | |
|---|---|---|---|
| 1,076,116 | A | 10/1913 | Hatfield |
| 1,694,487 | A | 12/1928 | Ringer |
| 1,799,831 | A | 4/1931 | Pauls |
| 2,121,190 | A | 6/1938 | Fellowes |
| 2,257,536 | A | 9/1941 | Roycroft |
| 2,299,766 | A | 10/1942 | Rosenthal |
| 2,364,083 | A | 12/1944 | Lindsay |
| D158,479 | S | 5/1950 | Long |
| 2,663,449 | A | 12/1953 | Smart |
| 2,697,631 | A | 12/1954 | Miller |
| 3,027,045 | A | 5/1961 | Wilson |

(Continued)

FOREIGN PATENT DOCUMENTS

AU B69962191 10/1991

(Continued)

OTHER PUBLICATIONS

Shopwiki, "Organizer Bins-Lookers-Locker Organizers-Magnetic Storage Bins," http://www.shopwiki.com/_Organizer+Bins+-+Lookers-+-+Locker+Organizers+-+Magnetic+Storage+Bins, printed on Aug. 2, 2009, 2 pages.

(Continued)

*Primary Examiner* — David Dunn
*Assistant Examiner* — Ryan A Doyle
(74) *Attorney, Agent, or Firm* — Griffiths & Seaton PLLC

(57) ABSTRACT

A storage shell includes a plurality of sidewalls to collectively define a chamber therebetween. A first sidewall defines a panel and a track. The panel defines an outer perimeter edge, an exterior surface, and holes extending through the panel. The track is coupled to the panel and includes a first rib and a second rib each extending from the exterior surface. The first rib is positioned inside the outer perimeter edge. The second rib is concentric with and shaped similarly to the first rib. The first rib and the second rib each separately border each one of the holes where each of the holes is formed between the first rib and the second rib. Related storage and organization systems, accessories and methods are also disclosed and provide additional advantages.

21 Claims, 13 Drawing Sheets

U.S. PATENT DOCUMENTS

D197,311 S 1/1964 Spaak
3,117,692 A 1/1964 Carpenter et al.
3,170,594 A 2/1965 Nascher
3,254,440 A 6/1966 Duggar
3,254,786 A 6/1966 Melville
3,279,873 A 10/1966 Gronquist
3,421,656 A 1/1969 Asenbauer
3,468,591 A 9/1969 Wodli
3,506,321 A 4/1970 Hampel
3,552,579 A 1/1971 Simon et al.
3,563,624 A 2/1971 Stice
3,583,780 A 6/1971 Berkowitz
3,655,065 A 4/1972 Yellin
3,661,434 A 5/1972 Alster
D225,815 S 1/1973 Torrey
3,722,704 A 3/1973 Piretti
3,722,971 A 3/1973 Zeischegg
3,743,372 A 7/1973 Ruggerone
3,822,924 A 7/1974 Lust
D232,812 S 9/1974 Ogle et al.
3,836,217 A 9/1974 Shiina
3,836,218 A 9/1974 Hallal
3,853,367 A 12/1974 Jamison et al.
3,856,147 A 12/1974 Piretti
3,874,753 A 4/1975 Naito et al.
3,885,845 A 5/1975 Krieks
D238,051 S 12/1975 Fier, Jr.
3,975,877 A 8/1976 Walton
4,047,773 A 9/1977 Semany
4,050,604 A 9/1977 Flanders
D246,872 S 1/1978 White
D251,480 S 4/1979 Cherry
4,192,562 A 3/1980 Bishoff et al.
4,196,948 A 4/1980 Gavel et al.
D256,196 S 8/1980 Kates
4,261,627 A 4/1981 Felsenthal
D268,622 S 4/1983 Wolters et al.
4,403,554 A 9/1983 Valentine et al.
4,448,463 A 5/1984 Amos
4,470,647 A 9/1984 Bishoff et al.
D278,663 S 5/1985 Zeischegg et al.
D279,945 S 8/1985 Zeischegg et al.
4,593,816 A 6/1986 Langenbeck
4,673,087 A * 6/1987 Webb ..... 206/600
4,704,313 A 11/1987 Maier
4,707,038 A 11/1987 Voegeli
4,717,214 A 1/1988 Moore et al.
4,742,931 A 5/1988 Bennett
4,782,637 A 11/1988 Eriksson et al.
4,782,972 A * 11/1988 Wenkman et al. ..... 220/4.28
4,863,222 A 9/1989 Posso
D323,296 S 1/1992 Schoenthaler
D326,345 S 5/1992 Mandell et al.
5,119,610 A 6/1992 Birkeland et al.
5,147,120 A 9/1992 Ray
D330,161 S 10/1992 Schuh
5,176,435 A 1/1993 Pipkens
D349,646 S 8/1994 Dickinson
5,356,031 A 10/1994 Jondelius
5,357,728 A 10/1994 Duncanson
D358,328 S 5/1995 Huerto et al.
D360,898 S 8/1995 Huerto et al.
D361,203 S 8/1995 Regnier
5,464,295 A 11/1995 Daillot
5,466,058 A * 11/1995 Chan ..... 312/111
5,477,594 A 12/1995 LePage
5,486,041 A 1/1996 Sykes
5,492,399 A 2/1996 Tillack
D368,162 S 3/1996 Miller
5,497,888 A 3/1996 Michaels et al.
5,562,224 A 10/1996 Pascal et al.
D376,259 S 12/1996 Dickinson et al.
5,584,412 A 12/1996 Wang
5,588,726 A 12/1996 Lee
5,615,797 A 4/1997 Ripamonti
5,647,649 A 7/1997 Kao
5,664,856 A 9/1997 Pacetti
5,680,744 A 10/1997 Kramedjian et al.
D387,559 S 12/1997 Williamson
5,716,116 A 2/1998 Carlson et al.
5,720,547 A 2/1998 Baird
5,775,046 A 7/1998 Fanger et al.
D396,566 S * 8/1998 Albrecht ..... D6/349
D404,571 S 1/1999 Evans
5,888,114 A * 3/1999 Slocum et al. ..... 446/128
5,902,025 A 5/1999 Yu
5,913,580 A 6/1999 Liu
5,921,646 A 7/1999 Hwang
5,941,616 A 8/1999 Billingham
6,024,626 A 2/2000 Mendelsohn
D421,678 S 3/2000 Levy
6,039,202 A 3/2000 Olstad et al.
D427,769 S 7/2000 Zimmerman
6,113,203 A 9/2000 Chen
D431,907 S 10/2000 Andujar et al.
D437,706 S 2/2001 Alcala et al.
6,193,340 B1 * 2/2001 Schenker et al. ..... 312/265.5
6,209,976 B1 4/2001 Shear
D454,454 S 3/2002 Hamilton et al.
6,352,323 B1 3/2002 Rives
D455,292 S 4/2002 Hardy et al.
6,488,346 B2 12/2002 Chen
6,508,021 B2 1/2003 Ong
6,536,856 B2 3/2003 Pelizzari et al.
6,557,955 B2 5/2003 Saravis
6,698,853 B2 3/2004 Chen et al.
D495,248 S 8/2004 Krebs et al.
6,820,950 B1 * 11/2004 Sun ..... 312/108
6,834,920 B2 * 12/2004 Landsberger et al. ..... 312/257.1
6,848,758 B1 2/2005 Yeh et al.
6,938,966 B1 9/2005 Rouwhorst
6,942,306 B2 9/2005 Youngs et al.
RE38,836 E 10/2005 Krause et al.
6,962,262 B2 11/2005 Toma
6,966,450 B2 11/2005 Askew
6,971,529 B1 12/2005 Shapiro
6,991,115 B2 1/2006 Chow et al.
7,048,346 B2 5/2006 Saravis
D540,039 S 4/2007 van Beuningen
7,231,740 B2 6/2007 Jirele
7,261,219 B2 8/2007 Tucker et al.
7,472,969 B2 1/2009 Saravis
7,507,136 B2 3/2009 Patton
D594,657 S 6/2009 McAlpine
7,588,162 B2 9/2009 Dube et al.
7,621,421 B2 11/2009 Ohayon
7,984,820 B2 7/2011 Dancyger
2002/0093272 A1 7/2002 Saravis
2002/0109442 A1 * 8/2002 Hsu ..... 312/263
2002/0185941 A1 * 12/2002 Ferraro et al. ..... 312/107
2003/0184199 A1 10/2003 Jananji
2003/0193274 A1 10/2003 Saravis
2003/0222545 A1 12/2003 Stravitz
2004/0164653 A1 8/2004 Winkless
2004/0217677 A1 * 11/2004 Durand et al. ..... 312/108
2005/0006991 A1 1/2005 Saravis
2005/0077805 A1 4/2005 Dalebout et al.
2005/0088068 A1 4/2005 Chang
2005/0104483 A1 * 5/2005 Saravis ..... 312/111
2005/0168116 A1 8/2005 Chuang
2005/0264147 A1 12/2005 Norris et al.
2006/0080928 A1 4/2006 Kichijo et al.
2006/0244348 A1 11/2006 Richied et al.
2006/0250052 A1 * 11/2006 Davis et al. ..... 312/107
2007/0052330 A1 * 3/2007 Chang ..... 312/111
2007/0158347 A1 * 7/2007 Ohayon ..... 220/23.6
2008/0011697 A1 1/2008 Berg
2008/0017596 A1 1/2008 Brock
2008/0040982 A1 * 2/2008 Durand et al. ..... 52/36.1
2008/0074013 A1 * 3/2008 Ahlgrim et al. ..... 312/108
2008/0128428 A1 6/2008 Beckerman
2008/0258593 A1 10/2008 Berger
2010/0237754 A1 * 9/2010 Zalewski et al. ..... 312/111

FOREIGN PATENT DOCUMENTS

DE 3020836 A 12/1981
DE 3302105 7/1983

| | | | |
|---|---|---|---|
| DE | 3933611 | | 4/1991 |
| DE | 4313330 | | 9/1994 |
| DE | 19735185 | | 2/1999 |
| DE | 19949849 | | 2/2001 |
| DE | 20309712 | U | 8/2003 |
| EP | 0270495 | | 6/1988 |
| EP | 0614017 | | 9/1994 |
| EP | 0801912 | | 10/1997 |
| FR | 2316679 | | 1/1977 |
| FR | 2376677 | | 8/1978 |
| FR | 2862356 | | 5/2005 |
| GB | 2101202 | A | 1/1983 |
| GB | 2206280 | | 1/1989 |
| GB | 2231820 | A | 11/1990 |
| GB | 2355672 | | 5/2001 |
| GB | 2370239 | A | 6/2002 |
| WO | 8700406 | | 1/1987 |
| WO | 9920153 | | 4/1999 |
| WO | 0127395 | | 4/2001 |

OTHER PUBLICATIONS

"iCube, my cube, my spaceTM", materials publicly provided in an offer to sell the associated product at least as early as Apr. 23, 2008, 22 pages.

EGAN Visual, Inc., "Modular Storage . . . configured to your requirements," 2004, 2 pages.

EGAN Visual, Inc., "Finish Schedule," Price and Specification Guide, Jul. 2002, 11 pages.

EGAN Visual, Inc., "Finish Schedule," Price and Specification Guide, Jul. 2002, 3 pages.

EGAN Visual, Inc., "Mobile Task Carts & Lockers—Product Design Rationale," 2004, 2 pages.

MODULINE Modular Aluminum Cabinets, "Moduline Pro-Series Combinations—Trailer Cabinets Organize With Style!—Modular Aluminum Storage Cabinets," printed from www.modulinecabinets.com in May 2006, 3 pages.

"elfa® Platinum Garage System," printed from www.organize.com in May 2006, 2 pages.

"The Cube Storage System," printed from www.organize.com in May 2006, 2 pages.

"Storage Cubes: A Unique 5 Piece Modular Storage System—Cherry," printed from www.organize.com in May 2006, 2 pages.

"elfa® Basic 9' Double Hang Closet," printed from www.organize.com in May 2006, 2 pages.

"Closits Modular Furniture System—Maple," printed from www.target.com in May 2006, 3 pages.

"QBO Storage Solution," www.topdeq.com/topdeq/product.do@catid=us_75&prodid=pp_QBO, printed in May 2006, 2 pages.

"Cubo Modular Storage," www.topdeq.com/topdeq/product.do@catid=us_75&prodid=pp_CUBIC, printed in May 2006, 3 pages.

Storage Member publicly available in IKEA stores at least as early as Jan. 2000.

* cited by examiner

STORAGE AND ORGANIZATION SYSTEM AND CONNECTIVITY OF THE COMPONENTS THEREIN

CROSS-REFERENCE TO RELATED APPLICATIONS

The present application is a Non-Provisional Application of U.S. Provisional Application No. 61/160,977, entitled "STORAGE AND ORGANIZATION SYSTEM AND CONNECTIVITY OF THE COMPONENTS THEREIN," filed on Mar. 17, 2009, which is related to U.S. Utility Patent application Ser. No. 11/851,165, entitled "STORAGE AND ORGANIZATION SYSTEM AND COMPONENTS THEREOF," filed Sep. 6, 2007, now U.S. Pat. No. 7,866,769, issued Jan. 11, 2011; U.S. Design application Ser. No. 29/284,375, entitled "STORAGE BIN," filed Sep. 6, 2007, now U.S. Pat. No. D602,255, issued Oct. 20, 2009; U.S. Design application Ser. No. 29/284,379, entitled "LID PORTION," filed Sep. 6, 2007, now U.S. Pat. No. D592,402, issued May 19, 2009; U.S. Design application Ser. No. 29/329,629, entitled "STORAGE BIN," filed Dec. 18, 2008, now U.S. Pat. No. D596,857, issued Jul. 28, 2009; U.S. Provisional Application No. 61/161,019, entitled "STORAGE AND ORGANIZATION SYSTEM WITH STACKABLE SHELLS," filed on Mar. 17, 2009; U.S. Design application Ser. No. 29/333,915, entitled "STORAGE UNIT AND STORAGE UNIT PORTIONS," filed on Mar. 17, 2009, now U.S. Pat. No. D622,959, issued Sep. 7, 2010; U.S. Design application Ser. No. 29/333,916, entitled "DRAWER," filed on Mar. 17, 2009, now U.S. Pat. No. D619,832, issued Jul. 20, 2010; U.S. States Design application Ser. No. 29/333,917, entitled "SUPPORTING BASE," filed on Mar. 17, 2009, now U.S. Pat. No. D617,582, issued Jun. 15, 2010; and U.S. Design application Ser. No. 29/333,918, entitled "TRAY," filed on Mar. 17, 2009, now U.S. Pat. No. D605,896, issued Dec. 15, 2009; all of which are incorporated herein by reference.

BACKGROUND OF THE INVENTION

Many organization and storage items and systems are available to assist consumers in storing and organizing their belongings. However, in general, consumers continually accumulate items and/or transfer items from one location in a home to another. Accordingly, a storage and organization system that may function well for a consumer at one point in time may gradually become ill suited for the consumer's needs at a subsequent time. In order to adapt to their changing needs, consumers often discard and replace old organization systems with new, more suitable systems. In this manner, as the needs of a consumer continue to evolve, a cycle of implementing and replacing organization systems often occurs. This cycle, which may seem to be never ending, can leave a consumer frustrated and distraught with attempts to organize the typically increasing inventory of belongings according to the consumer's evolving use of such belongings.

SUMMARY OF THE INVENTION

One aspect of the present invention relates to a storage shell including a plurality of sidewalls collectively defining a chamber therebetween. A first sidewall defines a panel and a track. The panel defines an outer perimeter edge, an exterior surface, and holes extending through the panel. The track is coupled to the panel and includes a first rib and a second rib each extending from the exterior surface. The first rib is positioned inside the outer perimeter edge. The second rib is concentric with and shaped similarly to the first rib. The first rib and the second rib each separately border each one of the holes where each of the holes is formed between the first rib and the second rib. Related products, systems, components and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

A storage and organization system according to the embodiments described herein is configured to store a plurality of goods, such as a consumer's belongings, and to be easily reconfigured to evolve with the changing needs of the consumer. In one example, the system described herein is configured to be assembled without permanency while still providing a sturdy and aesthetically pleasing storage assembly. In one embodiment, although the general components of the system are configured for a plurality of purposes, additional accessory and other components are provided and configured to interface with the general components to personalize the system for use in a particular area of the home, at a particular time in a consumer's life, etc., based on the needs of the consumer. As such, in one example, the storage and organization system is an adaptable, aesthetically pleasing alternative to the plurality of mismatched organizational units generally available in the prior art.

Figure 9:
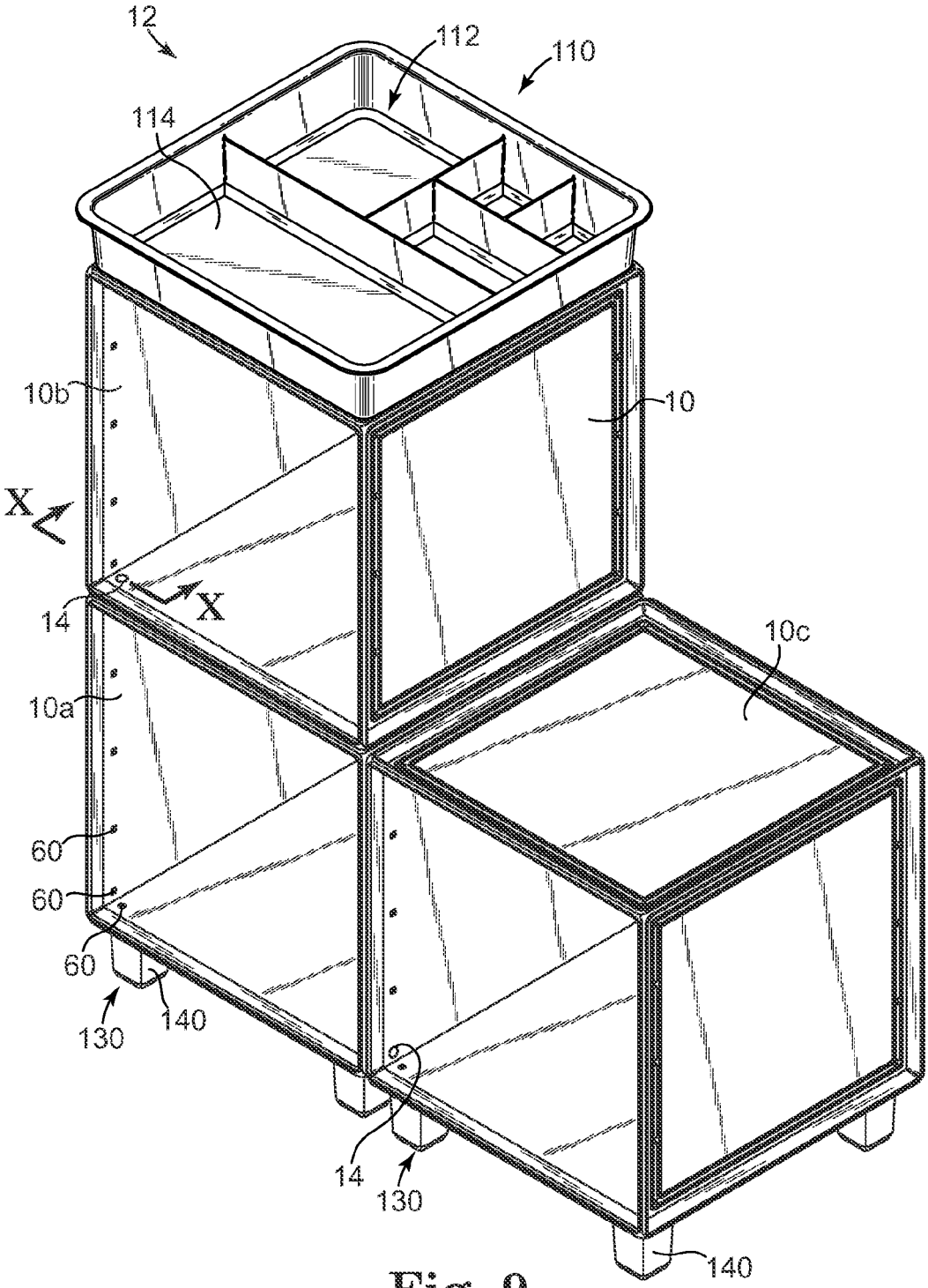
FIG. 9 illustrates a storage and organization system including the storage shell of FIG. 1, according to one embodiment of the present invention.
Figure 10:
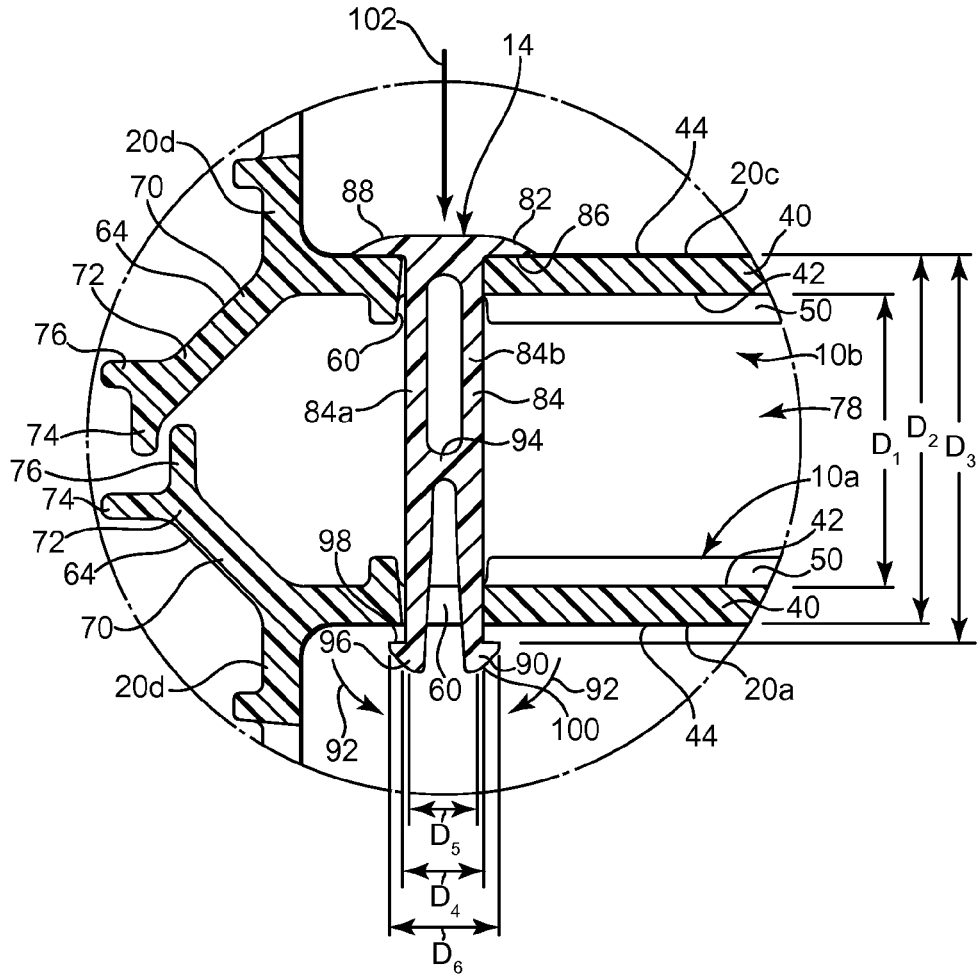
FIG. 10 illustrates a cross-sectional view as indicated by the line X-X in FIG. 9, according to one embodiment of the present invention.

Turning to the figures, FIGS. 1-8 each generally illustrate storage shell 10 (e.g., a storage box) or at least a portion thereof according to one embodiment of the present invention. Storage shell 10 serves as a basic building block of a storage and organization system 12 (for example, as illustrated in FIG. 9). Storage shells 10 are configured to be substantially modular and readily couplable and repositionable relative to one another without causing damage to any storage shell 10. In one embodiment, storage shells 10 are configured to be selectively coupled to one another using repositionable and reversible clips 14 (e.g., as illustrated in FIGS. 9 and 10), which will be further described below.

In one embodiment, each storage shell 10 defines four sidewalls 20*a*, 20*b*, 20*c*, and 20*d* (collectively referred to as sidewalls 20) and a rear wall 22. Each sidewall 20 is substantially rectangular (e.g., square) and extends between opposite edges of two other sidewalls 20 to define a rectangular box-like structure. Rear wall 22 is coupled to a rear edge 24 of each sidewall 20 such that a compartment 26 (e.g., a cavity, chamber, or void) is defined by storage shell 10 between sidewalls 20 and rear wall 22. A front opening 28 to compartment 26 is defined opposite rear wall 22 and is bordered by a front edge 30 of each of the sidewalls 20 opposite rear edges 24. As such, in one embodiment, storage shell 10 is essentially formed as a parallelepiped with an open face (i.e., front opening 28) opposite rear wall 22. In one embodiment, each storage shell 10 is formed from a single material, for example, a suitable plastic material or similar material injection or otherwise molded to form storage shell 10.

Figure 1:
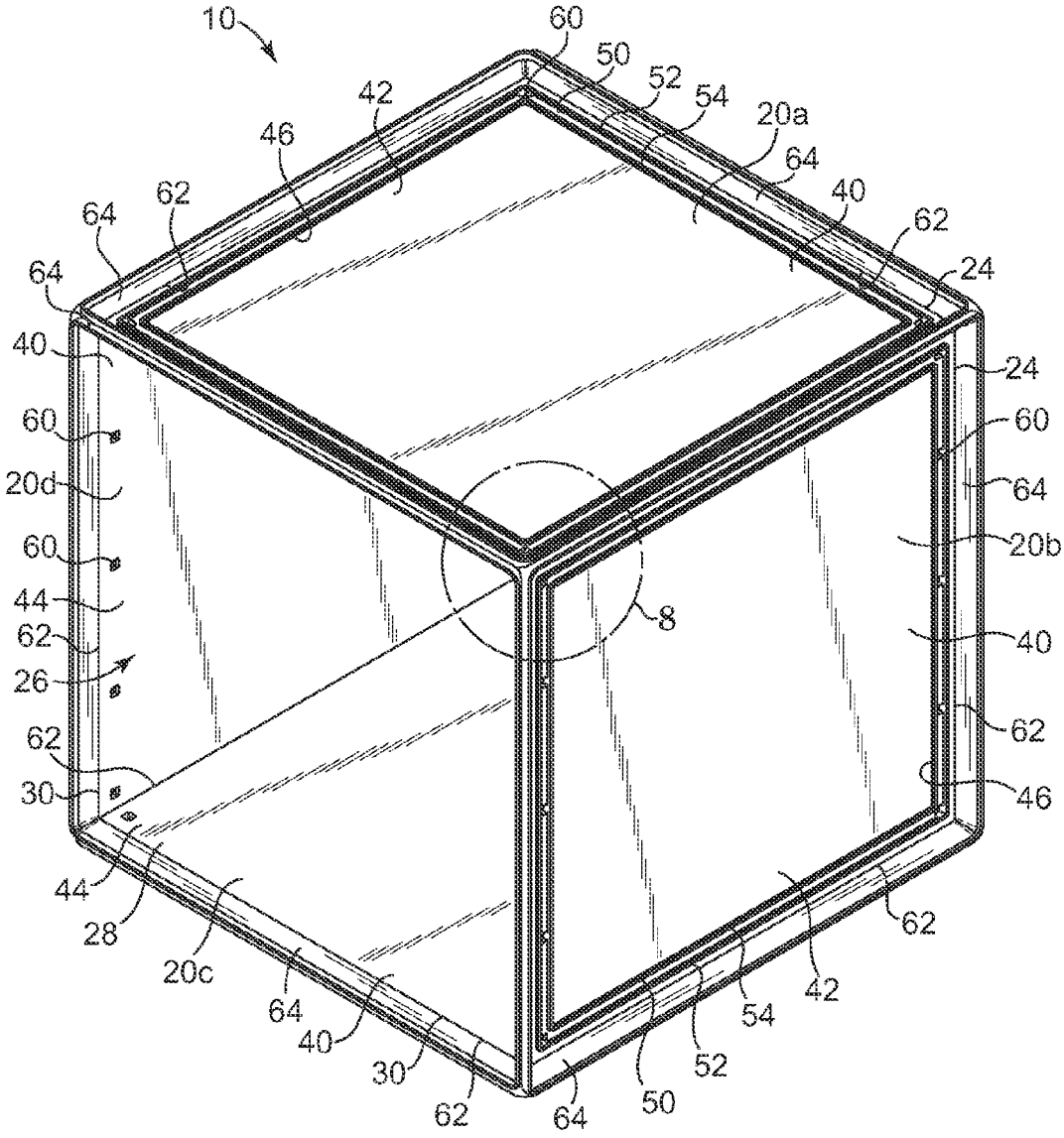
FIG. 1 illustrates a perspective view of a storage shell, according to one embodiment of the present invention.
Figure 2:
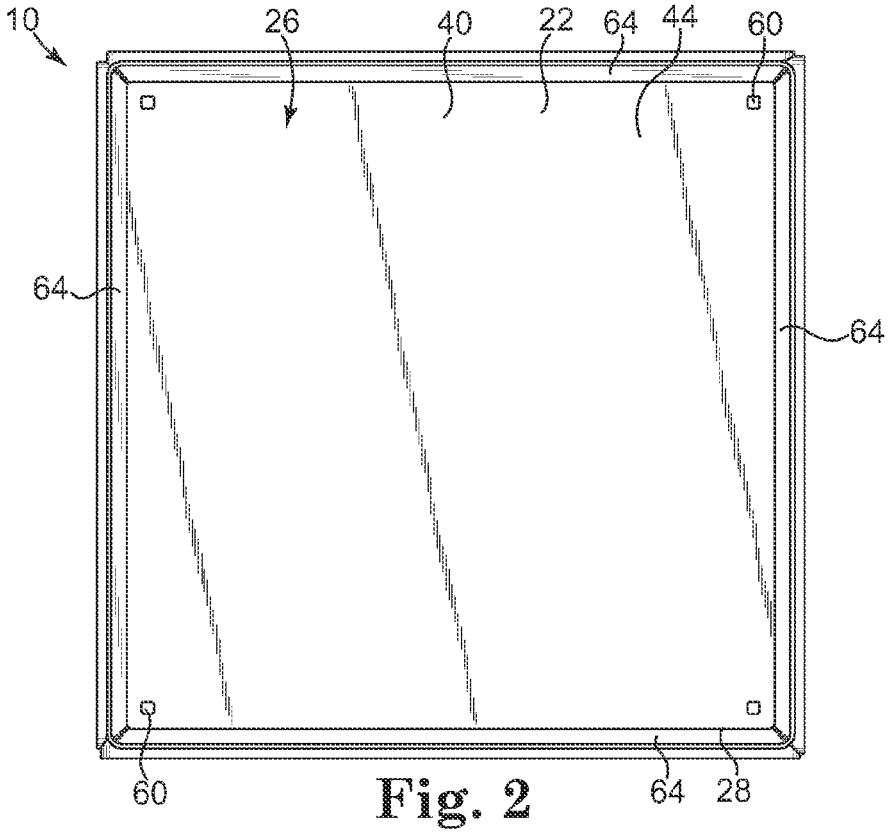
FIG. 2 illustrates a front view of the storage shell of FIG. 1, according to one embodiment of the present invention.
Figure 3:
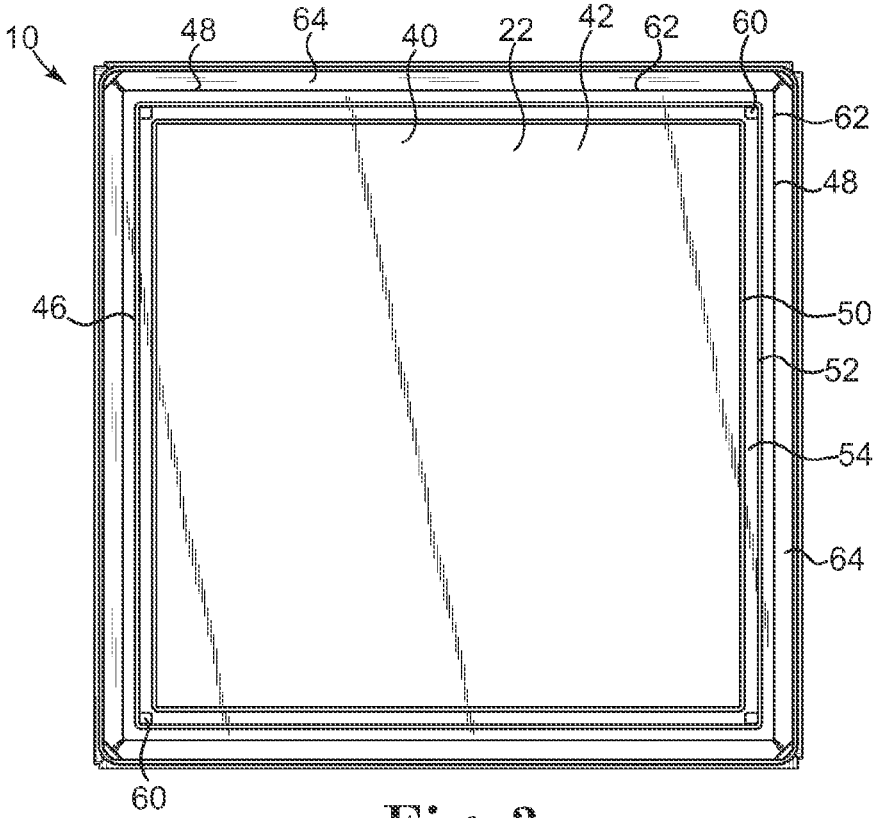
FIG. 3 illustrates a rear view of the storage shell of FIG. 1, according to one embodiment of the present invention.
Figure 4:
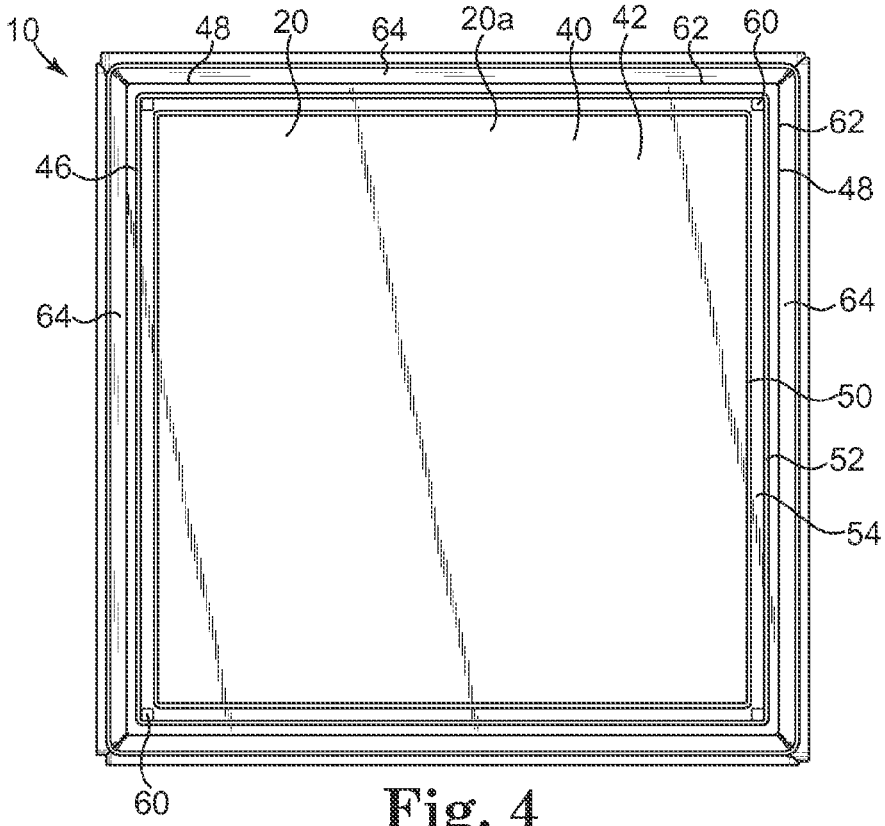
FIG. 4 illustrates a top view of the storage shell of FIG. 1, according to one embodiment of the present invention.
Figure 5:
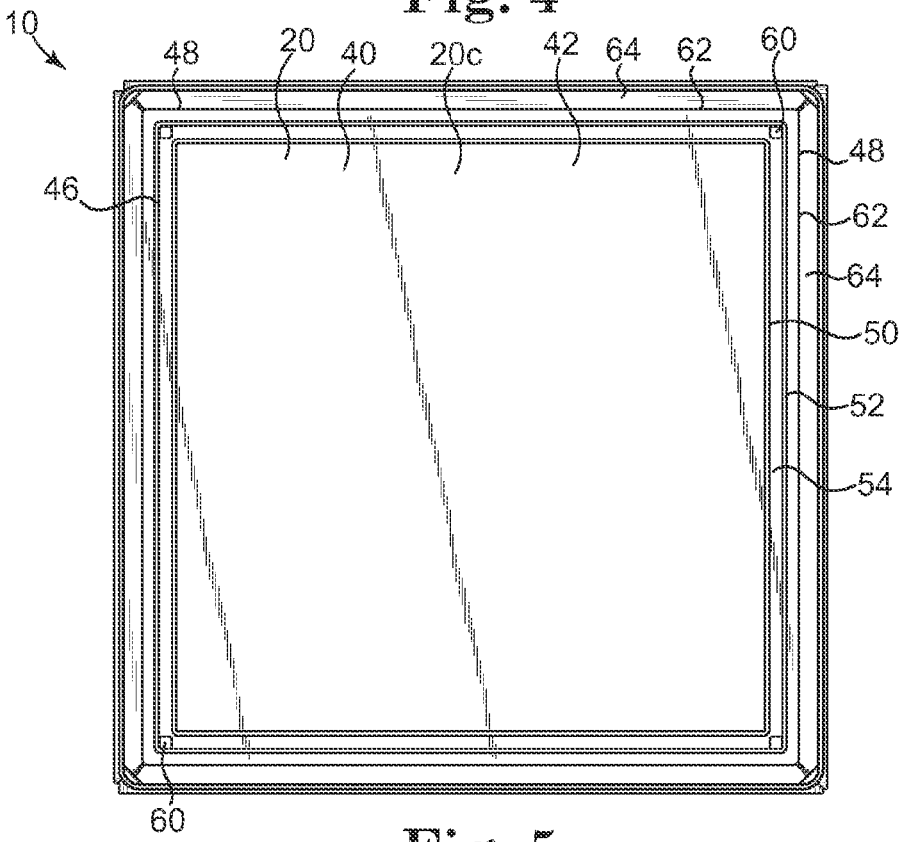
FIG. 5 illustrates a bottom view of the storage shell of FIG. 1, according to one embodiment of the present invention.
Figure 6:
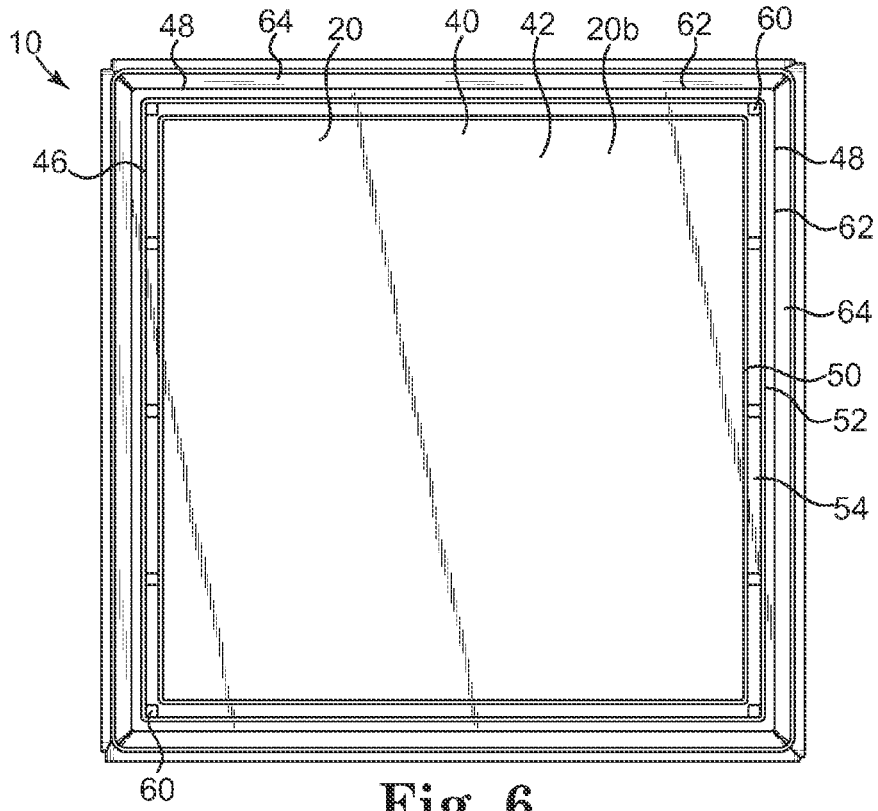
FIG. 6 illustrates a right side view of the storage shell of FIG. 1, according to one embodiment of the present invention.
Figure 7:
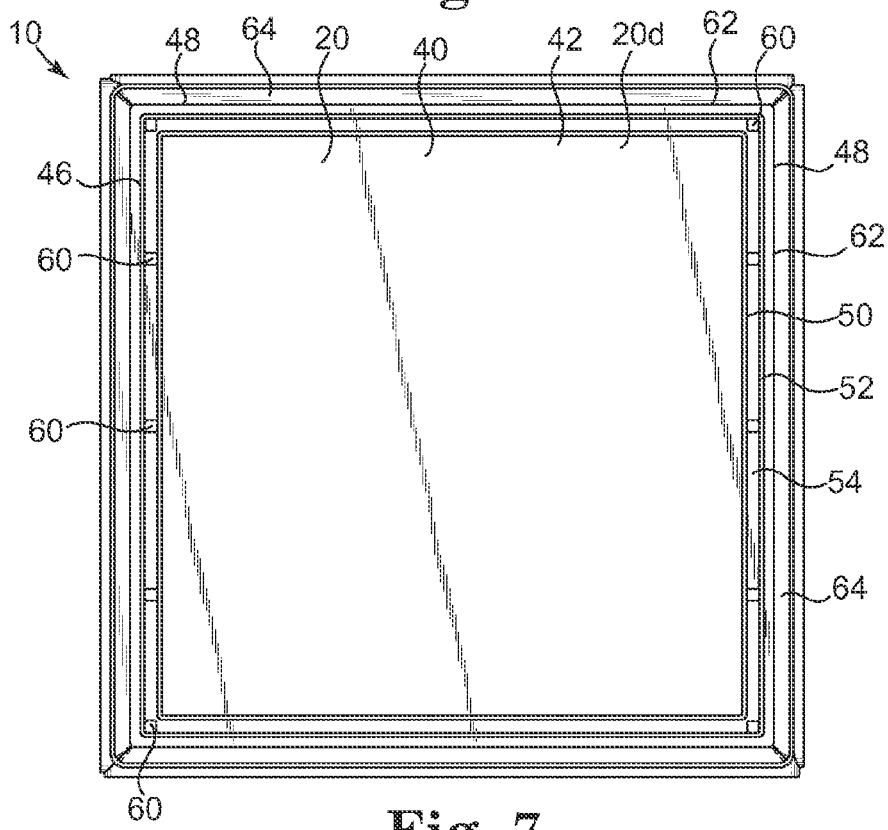
FIG. 7 illustrates a left side view of the storage shell of FIG. 1, according to one embodiment of the present invention.
Figure 8:
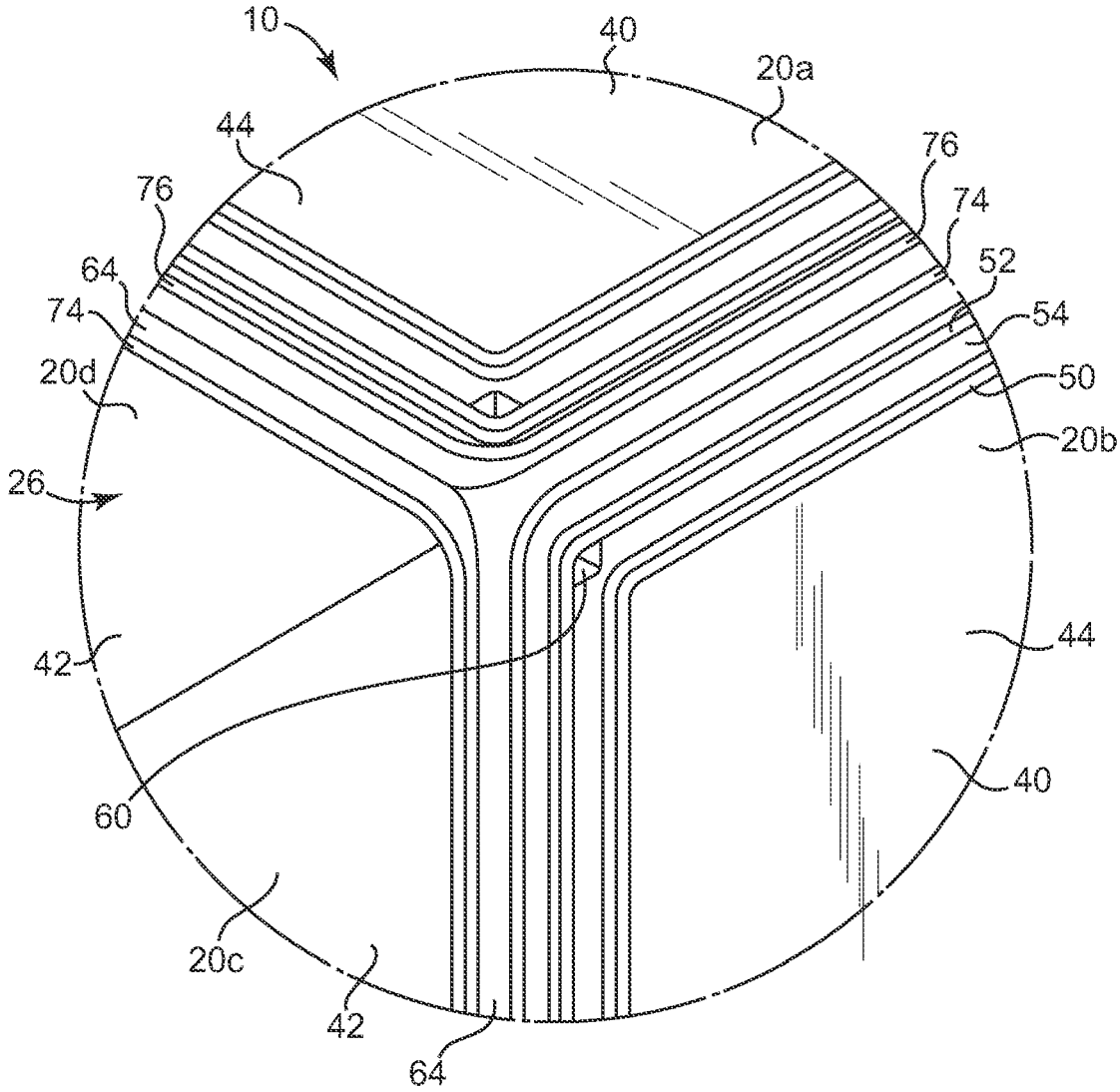
FIG. 8 illustrates a detail view of a portion of the storage shell as indicated in FIG. 1, according to one embodiment of the present invention.

Referring to FIG. 1, in one embodiment, each sidewall 20 includes a substantially planar panel 40 in a square or other rectangular shape defining an exterior surface 42 and an interior surface 44 opposite exterior surface 42. In one example, a separate track 46 extends outwardly (i.e., away from compartment 26) from exterior surface 42 of each substantially planar panel 40. Track 46, more specifically, extends around exterior surface 42 inset slightly from outer perimeter edges 48 of the corresponding substantially planar panel 40. As such, an outer perimeter of track 46 is shaped similarly to, but is slightly smaller than, an outer perimeter of a corresponding substantially planar panel 40.

In one example, track 46 includes a first or inner rib 50 and a second or outer rib 52. Inner rib 50 is positioned just inside and is concentric with outer rib 52. In one embodiment, inner rib 50 and outer rib 52 are each continuous and define four linear lengths in a generally square or otherwise rectangular manner. Track 46 defines an opening or groove 54 between inner rib 50 and outer rib 52. In one example, each of inner rib 50 and outer rib 52 and track 46 as a whole, provide additional rigidity and support to sidewalls 20. For instance, track 46 provides each substantially planar panel 40 with additional strength and decreases twisting, warping, or other deformations of substantially planar panel 40 when storage shell 10 is loaded with goods, etc. In one embodiment, use of track 46 allows substantially planar panel 40 to be formed thinner than if no track 46 were used as will be apparent to those of skill in the art upon reading the present application. Use of thinner walls decreases the amount of material needed to form each storage shell 10 and thereby reduces the cost of manufacturing the resultant storage shells 10.

In one example, one or more apertures or holes 60 extend through each sidewall 20, for example, in groove 54 of track 46. In one embodiment, each hole 60 is substantially square or otherwise rectangular in shape. In one embodiment, a hole 60 is defined in each of the four corners of track 46 in each of the four sidewalls 20 and rear wall 22. Additional holes 60 may be defined along one or more linear lengths of track 46. In one example, some sidewalls 20 include similar numbers and positioning of holes 60 while other sidewalls 20 and/or rear wall 22 may have different numbers and/or arrangements of holes 60. For example, top and bottom sidewalls 20*a* and 20*c*, which are positioned opposite and parallel to one another, only have holes 60 in the corners of the corresponding tracks 46. Vertical sidewalls 20*b* and 20*d*, which are positioned opposite and parallel to one another and perpendicular to top and bottom sidewalls 20*a* and 20*c*, include holes 60 in the corners of the corresponding tracks 46 and additionally each include a plurality of holes 60 linearly spaced at equal distances from one other along at least two of the linear lengths of each track 46. For example, vertical sidewalls 20*b* and 20*d* each have a plurality of holes 60 defined in portions of the groove 54 defined along the front and rear lengths (i.e., the vertical lengths) of the corresponding tracks 46.

An intersection line 62 is defined at the border between any one sidewall 20, rear wall 22, or front opening 28 and another sidewall 20, rear wall 22, or front opening 28. Accordingly, in one embodiment, twelve intersection lines 62 are formed by storage shell 10 including four around front opening 28, four around rear wall 22, and four extending front to back and being defined at the boundary between adjacent sidewalls 20. Additionally referring to the cross-sectional view of FIG. 10, in one embodiment, a flange 64 extends radially outwardly from one or more of the intersection lines 62, for example, from each intersection line 62, in a plane angled with respect to adjacent ones of sidewalls 20, rear wall 22, and front opening 28. As used herein, "radially" refers to a divergent extension of a member relative to a center of a corresponding storage shell 10 unless another reference is specifically provided. In one embodiment, each flange 64 radially extends from intersection line 62 at an angle between about 30° and about 60° as measured from each adjacent sidewall 20, rear wall 22, or front opening 30, for example, at an angle of about 45°.

In one embodiment, each flange 64 is substantially Y-shaped and includes a primary leg 70 extending from the corresponding intersection line 62 to define an outer end 72 opposite the corresponding intersection line 62. In one example, flange 64 additionally includes first and second auxiliary legs 74 and 76 extending substantially perpendicular to one another. In one embodiment, each of first and second auxiliary legs 74 and 76 extends from outer end 72 of primary leg 70 at an angle of between about 30° and about 60° from primary leg 70, for example, at an angle of about 45°. In one example, first and second auxiliary legs 74 and 76 each extend substantially parallel to at least one of sidewalls 20 and rear wall 22.

Referring to FIG. 9, multiple storage shells 10 are configured to be stacked and arranged to define a storage and organization system 12 in a modular manner. To facilitate a user in configuring the multiple storage shells 10, storage shells 10 are configured to be easily secured to one another without the use of tools other than connection clips 14 (e.g., connection devices). For example, two storage shells 10 may be stacked such that a bottom or first storage shell 10*a* supports a top or second storage shell 10*b*.

When shells 10 are stacked, two or more (e.g., all four) of flanges 64 adjacent top sidewall 20*a* of first storage shell 10*a* interact with two or more (e.g., all four) of flanges 64 adjacent bottom sidewall 20*c* of second storage shell 10*b*, for example, as illustrated in the cross-sectional view of FIG. 10. In one example, when the above-described flanges 64 interact, second auxiliary legs 76 of flanges 64 adjacent top sidewall 20*a* of first storage shell 10*a* are positioned adjacent and nest with first auxiliary legs 74 of flanges 64 adjacent bottom sidewall 20*c*. This nesting substantially maintains second storage shell 10*b* in place relative to first storage shell 10*a*, more particularly in place from side to side and from front to back of storage shells 10. For example, second auxiliary legs 76 of flanges 64 adjacent top sidewall 20*a* of first storage shell 10*a* extend just inside first auxiliary legs 74 of flanges 64 adjacent bottom sidewall 20*c*. In one embodiment, the opposite configuration of second auxiliary legs 76 of flanges 64 adjacent top sidewall 20*a* of first storage shell 10*a* and first auxiliary legs 74 of flanges 64 adjacent bottom sidewall 20*c* may be used as will be apparent to those of skill in the art upon reading this application.

Interaction between flanges 64 maintains top sidewall 20*a* of first storage shell 10*a* spaced from and positioned substantially parallel to bottom sidewall 20*c* of second storage shell 10*b*. For example, first auxiliary legs 74 of flanges 64 adjacent bottom sidewall 20*c* of second storage shell 10*b* rests on first auxiliary legs 74 of flanges 64 adjacent top sidewall 20*a* of first storage shell 10*a*. The above-described flange 64 interactions maintain top sidewall 20*a* of first storage shell 10*a* spaced from bottom sidewall 20*c* of second storage shell 10*b*. Notably, first auxiliary leg 74 of flanges 64 adjacent bottom sidewall 20*c* of second storage shell 10*b* are shown slightly spaced from first auxiliary leg 74 of flanges 64 adjacent top sidewall 20*a* of first storage shell 10*a*, in FIG. 10 for clarity of illustration as will be apparent to those of skill in the art upon reading the present application. When stacked, a cavity 78 is defined between bottom sidewall 20*c* of second storage shell 10*b* and top sidewall 20*a* of first storage shell 10*a*.

More specifically, a first distance $D_1$ (i.e., thickness of cavity 78) is defined between exterior surface 42 of bottom sidewall 20*c* of second storage shell 10*b* and exterior surface 42 of top sidewall 20*a* of first storage shell 10*a*. In one embodiment, distance $D_1$ is substantially larger than a total thickness of each sidewall 20 defined between the respective interior surface 44 and exterior surface 42 thereof. In one example, distance $D_1$ is at least four times larger than a total thickness of any one of sidewalls 20. A second distance $D_2$ is defined between interior surface 44 of bottom sidewall 20*c* of second storage shell 10*b* and interior surface 44 of top sidewall 20*a* of first storage shell 10*a*.

When first storage shell 10*a* and second storage shell 10*b* are stacked, holes 60 extending through top sidewall 20*a* of first storage shell 10*a* and holes 60 extending through bottom sidewall 20*c* of second storage shell 10*b* align with one another (e.g., from front to back and from left to right). As illustrated in FIGS. 9 and 10, clips 14 are used to secure adjacent storage shells 10 to one another. Each clip 14 includes a head 82 and two symmetrical legs 84 (i.e., first leg 84*a* and second leg 84*b* or, collectively, a pair of legs). Head 82 defines a substantially planar surface 86 having a larger outer perimeter than holes 60 and may be formed circular, square, or any other suitable shape. In one example, a surface 88 of head 82 opposite substantially planar surface 86 is substantially flat; however, surface 88 may be rounded or otherwise shaped.

Each of legs 84 extends from substantially planar surface 86 of head 82 to a free end 90. In one example, each leg 84 is elongated (e.g., substantially rectangular) and spaced from the other leg 84. More specifically, in one embodiment, outer and opposite surfaces of legs 84 are spaced from each other a distance less than an interior diameter (i.e., interior width) of holes 60 such that legs 84 are configured to fit through holes 60 in storage shells 10. In one example, legs 84 are formed of a slightly flexible and elastomeric material allowing legs 84 to flex in toward one another as generally indicated by arrows 92 in FIG. 10 when inward forces are applied thereto and to elastically return to their initial position when the inward forces are removed. In one embodiment, to limit the flexing of legs 84 toward one another, a bridge member 94 extends substantially perpendicular to and between legs 84. Bridge member 94 extends from legs 84 at points along a middle third of the length of legs 84, for example, substantially half way between substantially planar surface 86 and free ends 90. With bridge member 94 in place, flexing of legs 84 is primarily limited to a portion of each leg 84 extending between bridge member 94 and the corresponding free end 90.

In one example, a protrusion or claw 96 is defined near each free end 90. More specifically, one claw 96 extends from free end 90 of first leg 84*a* away from second leg 84*b*, and one claw 96 extends from free end 90 of second leg 84*b* away from first leg 84*a*. As such, claws 96 extend radially outwardly (i.e., away from one another) from each leg 84. In one embodiment, each claw 96 defines an interface surface 98, which, in one example, is substantially planar, on a portion of each claw 96 nearest and facing substantially planar surface 86 of head 82. In one embodiment, interface surfaces 98 extend substantially parallel to substantially planar surface 86. In one example, a distance $D_2$ is defined between interior surface 44 of bottom sidewall 20*c* of second storage shell 10*b* and interior surface 44 of top sidewall 20*a* of first storage shell 10*a*. A distance $D_3$ is defined between substantially planar surface 86 and interface surface 98 and is slightly larger than distance $D_2$ (the difference between the two distances being slightly exaggerated in FIG. 10 for illustrative clarity as will be apparent to those of skill in the art upon reading this application).

In one embodiment, claw 96 defines an angled surface 100 from a tip of free end 90 toward an outwardly most portion of interface surface 98. As such, angled surface 100 extends radially outwardly and toward head 82. At their closest points, angled surface 100 of first leg 84*a* and angled surface 100 of second leg 84*b* are spaced from one another a distance $D_5$, which is less that a diameter or width $D_4$ of holes 60. At their furthest spaced points, angled surface 100 of first leg 84*a* and angled surface 100 of second leg 84*b* are spaced from one another a distance $D_6$, which is greater than a diameter or width $D_4$ of holes 60. In one embodiment, each clip 14 is formed as a contiguous piece of a single material, for example, injection molded plastic.

When used to secure two storage shells 10 such as first storage shell 10*a* and second storage shell 10*b* to one another, clip 14 is pushed through holes 60 of both storage shells 10*a* and 10*b*. For example, as shown in FIGS. 9 and 10, clip 14 is pushed from interior surface 44 of bottom sidewall 20*c* of second storage shell 10*b* through a corresponding hole 60 formed therein and through a corresponding (i.e., aligned) hole 60 of top sidewall 20*a* of first storage shell 10*a*. More specifically, as clip 14 is pushed into hole 60 of bottom sidewall 20*c* of second storage shell 10*b* in the direction generally indicated by arrow 102, interior surface 44 of that bottom sidewall 20*c* interacts with angled surfaces 100 of clip 14 causing legs 84 of clip 14 to flex toward one another as generally indicated in FIG. 10 by arrows 92. Such flexing of legs 84 allows claw 96 of clip 14 to move through the hole 60 of bottom sidewall 20*c* of second storage shell 10*b*.

Once claw 96 clears hole 60 and track 46 of second storage shell 10*b*, legs 84 flex back to their initial position due to the elastomeric nature of the material used to form clip 14. When clip 14 is continued to move toward first storage shell 10*a* along the direction generally indicated by arrow 102, angled surfaces 100 of clip 14 to interact with track 46 of top sidewall 20*a* of first storage shell 10*a* again causing legs 84 of clip 14 to flex toward one another. Such flexing of legs 84 allows claw 96 of clip 14 to move through the top sidewall 20*a* of first storage shell 10*a*. Once claw 96 clears hole 60 of first storage shell 10*a*, legs 84 flex back to their initial position and claws 96 are positioned adjacent and substantially parallel to interior surface 44. In this position, clip 14 effectively holds first and second storage shells 10*a* and 10*b* together as claw 96 generally prevents clip 14 from moving back through top sidewall 20*a* of first storage shell 10*a* toward second storage shell 10*b* without purposeful user intervention with clip 14. In one embodiment, a clip 14 is similarly positioned between first storage shell 10*a* and second storage shell 10*b* through each of the corners holes 60 of bottom sidewall 20*c* of second storage shell 10*b* and top sidewall 20*a* of first storage shell 10*a*.

In one embodiment, when storage shells 10*a* and 10*b* are coupled to one another, top sidewall 20*a* of first storage shell 10*a* and bottom sidewall 20*c* of second storage shell 10*c* are maintained entirely spaced from one another even between corresponding tracks 46 of storage shells 10*a* and 10*b*. In other words, storage shells 10*a* and 10*b* only contact each other at free ends of flanges 64, for example, at auxiliary legs 74, 76. As such, a length of clip 14 independently extends between top sidewall 20*a* of first storage shell 10*a* and bottom sidewall 20*c* of second storage shell 10*c* entirely unsupported or bordered by any sidewall 20 or other portion of storage shells 10*a* and 10*b*. In one embodiment, the distance of clip 14 that is unsupported is over half the length of clip 14.

When clips 14 are so positioned coupling storage shells 10*a* and 10*b* to one another, tracks 46 provide additional structural stability to storage and organization system 12. Since holes 60 are positioned within grooves 54 defined by each track 46, at least two sides of holes 60 are reinforced by the corresponding adjacent ribs 50 and 52 of track 46, which, prevents or at least decreases any damage to adjacent sidewalls 20 that is caused by clips 14, for example, when clips 14 exert force on sidewalls 20 while holding adjacent storage shells 10 together. In addition, tracks 46 provide extra rigidity to individual sidewalls 20 allowing the sidewalls 20 to maintain their general shape and configuration even when supporting items for storage or use. In this manner, tracks 46 allow thinner sidewalls 20 to be made that still have sufficient rigidity to support any items placed in or on shells 10 for storage, which is of increased importance since sidewalls 20 of adjacent storage shells 10 do not contact or otherwise sit upon or support one another since only flanges 64 of adjacent storage shells 10 directly interact.

Additional storage shells 10 may be similarly coupled to one another using clips 14. Similarly, storage shells 10 may be secured side to side with clips 14 as generally indicated in FIG. 9 with first storage shell 10*a* and third storage shell 10*c*. Clips 14 also allow coupled storage shells 10 to be uncoupled from one another and reconfigured without the use of additional tools. For example, once again referring to FIG. 10, a user may apply a force as indicated by arrows 92 to free ends 90 of clip legs 84 causing free ends 90 to flex inward and to fit within the confines of holes 60. More specifically, while free ends 90 are flexed inward, a user pushes clip 14 toward second storage shell 10*b* causing free ends 90 to move through hole 60 within and through top sidewall 20*a* of first storage shell 10*a*. As such, first storage shell 10*a* is separated from second storage shell 10*b*. Clip 14 can similarly be flexed and moved back through bottom sidewall 20*c* of second storage shell 10*b* to separate clip 14 from second storage shell 10*b*.

Figure 11:
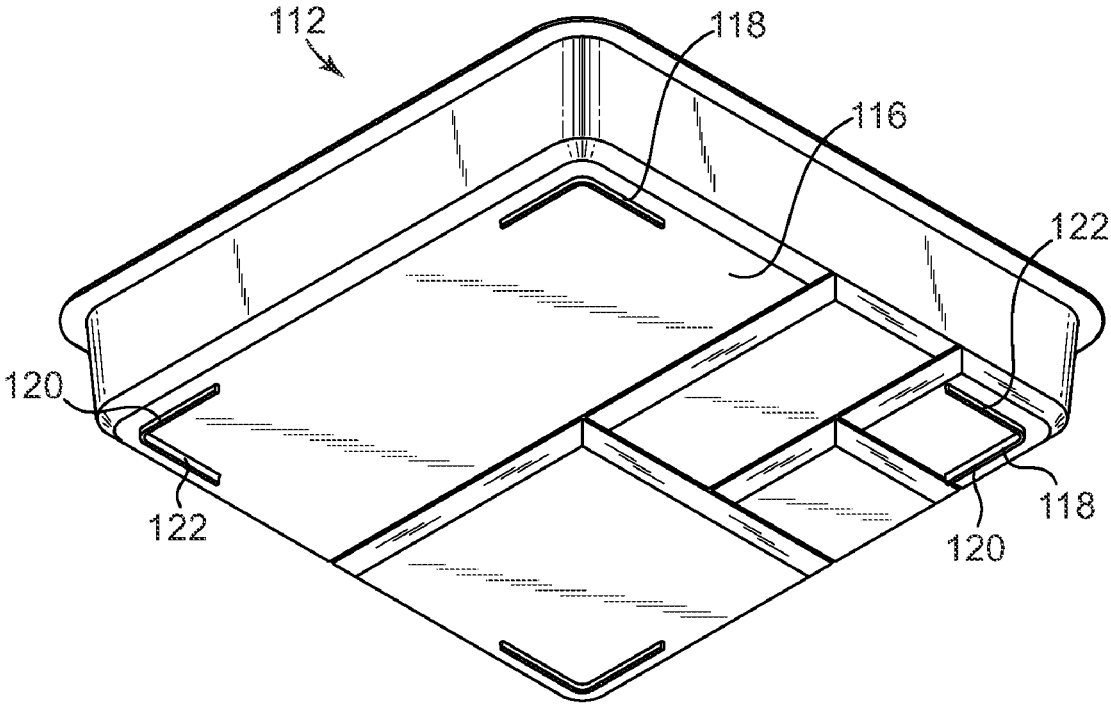
FIG. 11 illustrates a bottom perspective view of a tray for use with the storage shell of FIG. 1, according to one embodiment of the present invention.
Figure 12:
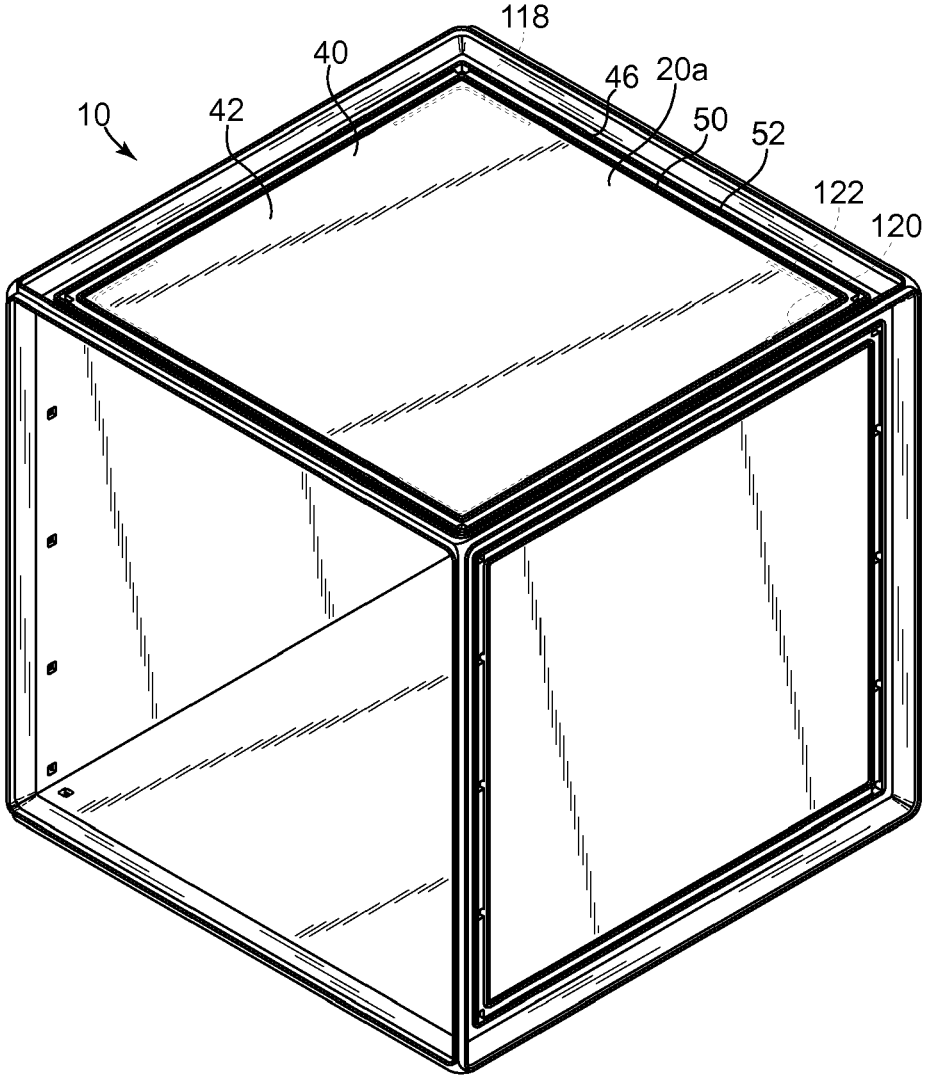
FIG. 12 illustrates a top portion of a storage shell with a portion of the tray of FIG. 11 illustrated in dashed lines, according to one embodiment of the present invention.

Besides facilitating coupling of storage shells 10 to one another, tracks 46 and holes 60 also facilitate coupling of accessory members 110 with storage shells 10. For example, referring to FIGS. 9 and 11, in one embodiment, accessory members 110 of storage and organization system 12 include a box or tray 112 defining one or more cavities 114 for storing or otherwise holding items. Tray 112 includes a bottom wall 116, which is substantially planar and may or may not be continuous. Ribs 118 extend downwardly from bottom wall 116, which, in one example, is substantially square or rectangular, near an outer perimeter thereof. In one example, a separate rib 118 is placed in each corner of bottom wall 116 and is generally L-shaped such that one leg 120 extends substantially perpendicular to another leg 122 of each rib 118. In one embodiment, ribs 118 are connected to one another to collectively define a closed-looped rib.

Ribs 118 are placed such that each leg 120 and 122 extends just inside an outer corner of bottom wall 116 and extends substantially parallel to a side edge of bottom wall 116. When tray 112 is placed on a top sidewall 20*a* of a storage shell 10, such as second storage shell 10*b*, at least one rib 118 is configured to fit within a corner of inner rib 50 of track 46. Where tray 112 is sized to cover substantially all of a top sidewall 20*a*, each rib 118 of tray 112 is configured to fit just inside a different corner of track 46. This interaction generally prevents or at least decreases side-to-side and/or front-to-back movement, especially, inadvertent movement, of tray 112 relative to top sidewall 20*a* of the respective storage shell 10.

As will be apparent to those of skill in the art upon reading this application, trays (not shown) sized differently than tray 112 may be used. For instance, two side-by-side trays may fit on top sidewall 20*a* of a storage shell 10 such that each tray has two ribs that interact with corners of track 46. For example, a first tray has two ribs where each rib interacts with the right side corners of track 46, and a second tray has two opposite ribs that each interact with the left side corners of track 46. Use of other numbers of trays configured to fit within track 46 of a single sidewall 20 is also contemplated.

Figure 13:
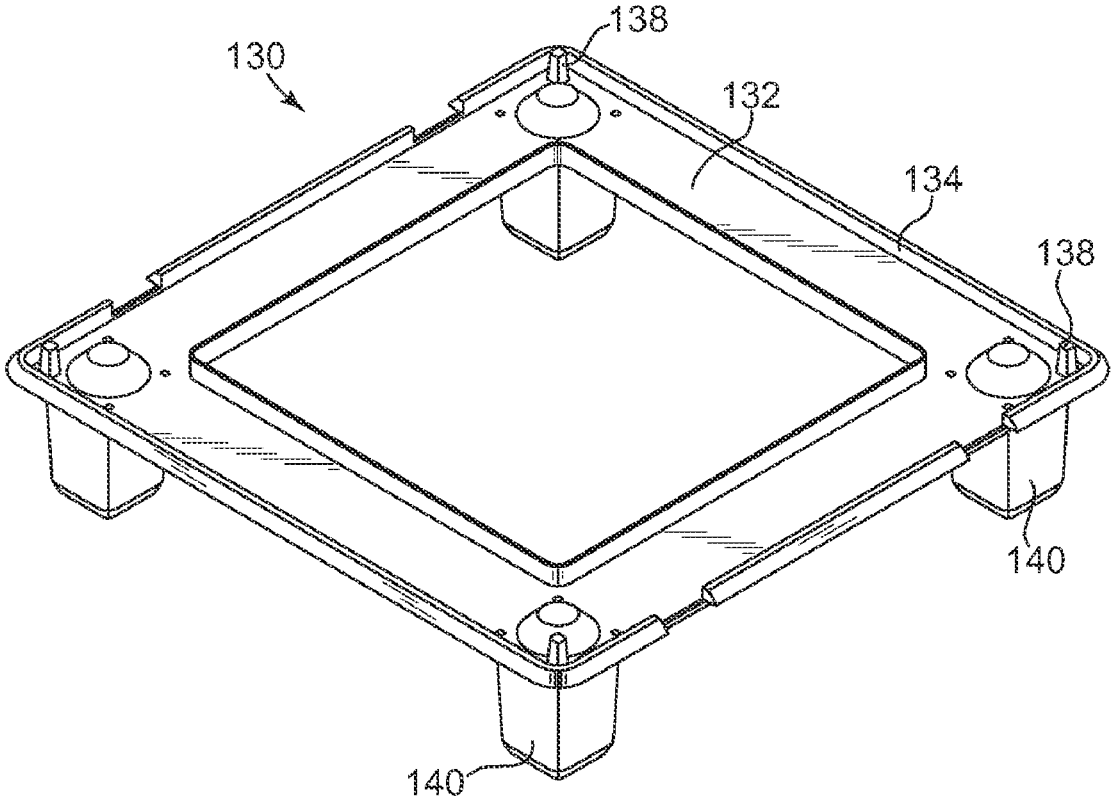
FIG. 13 illustrates a support base for use with the storage shell of FIG. 1, according to one embodiment of the present invention.

Referring to FIGS. 9 and 13, in one embodiment, accessory member(s) 100 include a support base 130. Support base 130 generally includes a substantially planar, primary panel 132 with raised edge 134 extending upwardly and around a perimeter thereof. Protruding pillars 138 also extend from primary panel 132, and each pillar 138 is positioned near and inset from a different corner of primary panel 132. Pillars 138 each extend away from primary panel 132 a distance greater than, for example, at least twice as far as, raised edge 134.

Legs 140 extend from corners of support base 130 in an opposite direction as raised edge 134 to provide height to base 130. Legs 140 may be static risers as illustrated in FIG. 13 or alternatively may incorporate casters or other support members as will be apparent to those of skill in the art upon reading this application.

Support base 130 is configured to interface with bottom sidewall 20*c* of a storage shell 10, for example, first storage shell 10*a* as illustrated in FIG. 9. More specifically, in one embodiment, each hole 60 in bottom sidewall 20*c* is sized, shaped, and positioned to receive a different one of pillars 138. In one embodiment, each pillar 138 is slightly tapered as it extends away from primary panel 132 such that as each pillar 138 is slid into a corresponding hole 60 it becomes tighter within hole 60 and is eventually held in place via friction fit. In one embodiment, raised edge 134 extends from primary panel 132 a similar distance as ribs 50 and 52 extend from substantially planar panels 40 of sidewalls 20. In one example, when support base 130 is coupled with a storage shell 10, raised edge 134 of support base 130 fits around outer rib 52 of track 46. As such, support base 130 is selectively coupled with the corresponding storage shell 10 and holds storage shell 10 above the ground, floor, or other support surface (not shown). Support base 130 is removable from the corresponding storage shell 10 simply by applying a force to move support base 130 away from storage shell 10 of a sufficient magnitude to overcome the friction fit between pillars 138 of support base 130 and holes 60 of shell 10.

Figure 14:
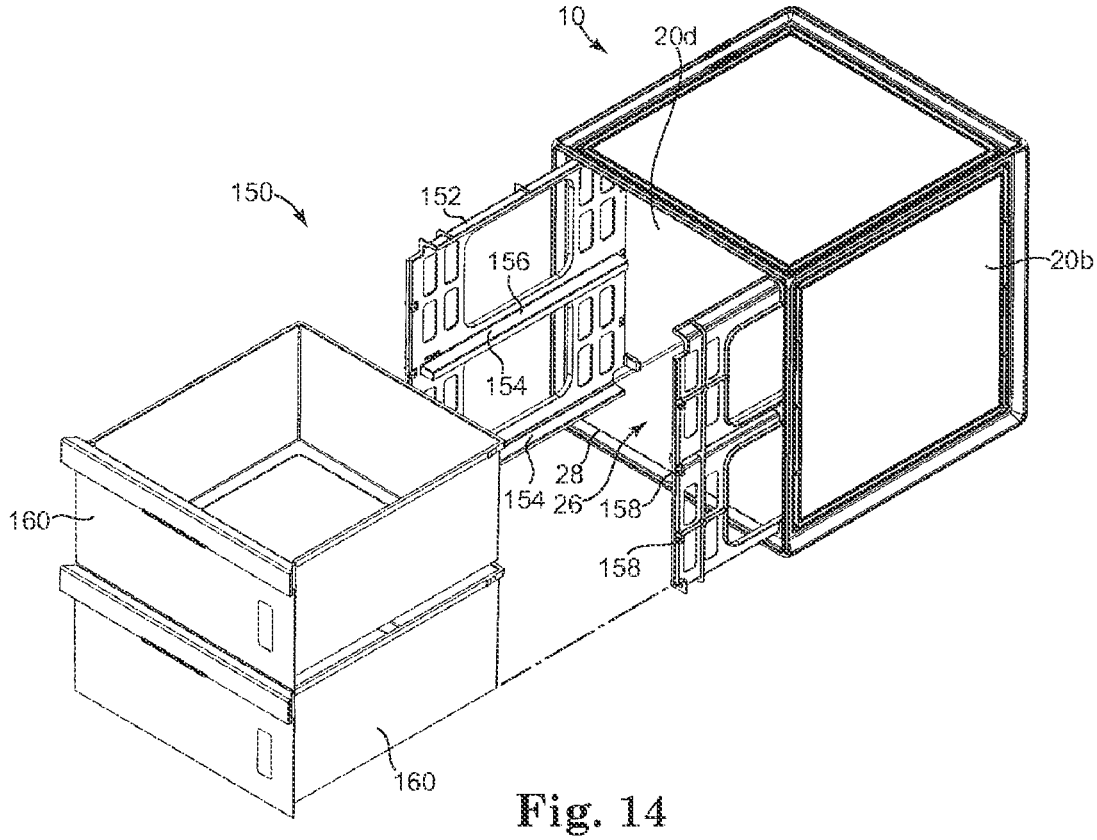
FIG. 14 illustrates the support shell of FIG. 1 with drawer and drawer support accessories, according to one embodiment of the present invention.

In one embodiment, accessory member(s) 100 also include interior members such as drawer unit 150 as illustrated in FIG. 14. Drawer unit 150 is configured to be inserted into compartment 26 of shell 10. In one embodiment, drawer unit 150 provides a pre-assembled and separately purchasable drawer sub-unit specifically configured to fit within a compartment 26 of shell storage 10. Drawer unit 150 is thereby configured to have similar, but slightly smaller, outside dimensions as compared to the inside dimensions of compartment 26 of storage shell 10. More specifically, drawer unit 150 includes vertical support walls 152 defining the outside dimensions of drawer unit 150. Support rails 154 extend inwardly from vertical support walls 152 and define a drawer support surface 156 on an upper portion thereof.

Connection tabs 158 extend from vertical support walls 152, and in one embodiment, are similar to, but not as long as, clip legs 84. Connection tabs 158 are sized, shaped, and positioned to selectively fit within holes 60 of vertical sidewalls 20*b* and 20*d* to selectively couple vertical support walls 152 with storage shell 10 within compartment 26. In one example, connection tabs 158 are only configured to interface with holes 60 of storage shell 10 that are not in respective corners of sidewalls 20 to avoid any conflict between clips 14 and connection tabs 158 (e.g., compare FIG. 9 with FIG. 14). In one embodiment, vertical support walls 152 are substantially eliminated and support rails 154 themselves include connection tabs 158 for selectively coupling support rails 154 to storage shell 10 as will be apparent to those of skill in the art upon reading the application.

Drawer unit 150 additionally includes one or more drawers 160 each configured to be selectively slid into and out of storage shell 10 upon assembly. More specifically, each drawer 160 is configured to be slidably supported on two opposite support rails (i.e., a support rail defined by each vertical support wall 152) such that drawers 160 can be repeatedly slid into and out of compartment 26.

Other accessory members 110, such as shelves, etc., are also contemplated as will be apparent to those of skill in the art upon reading this application and make use of holes 60 and/or track 46 to facilitate selective coupling with storage shells 10.

Figure 15:
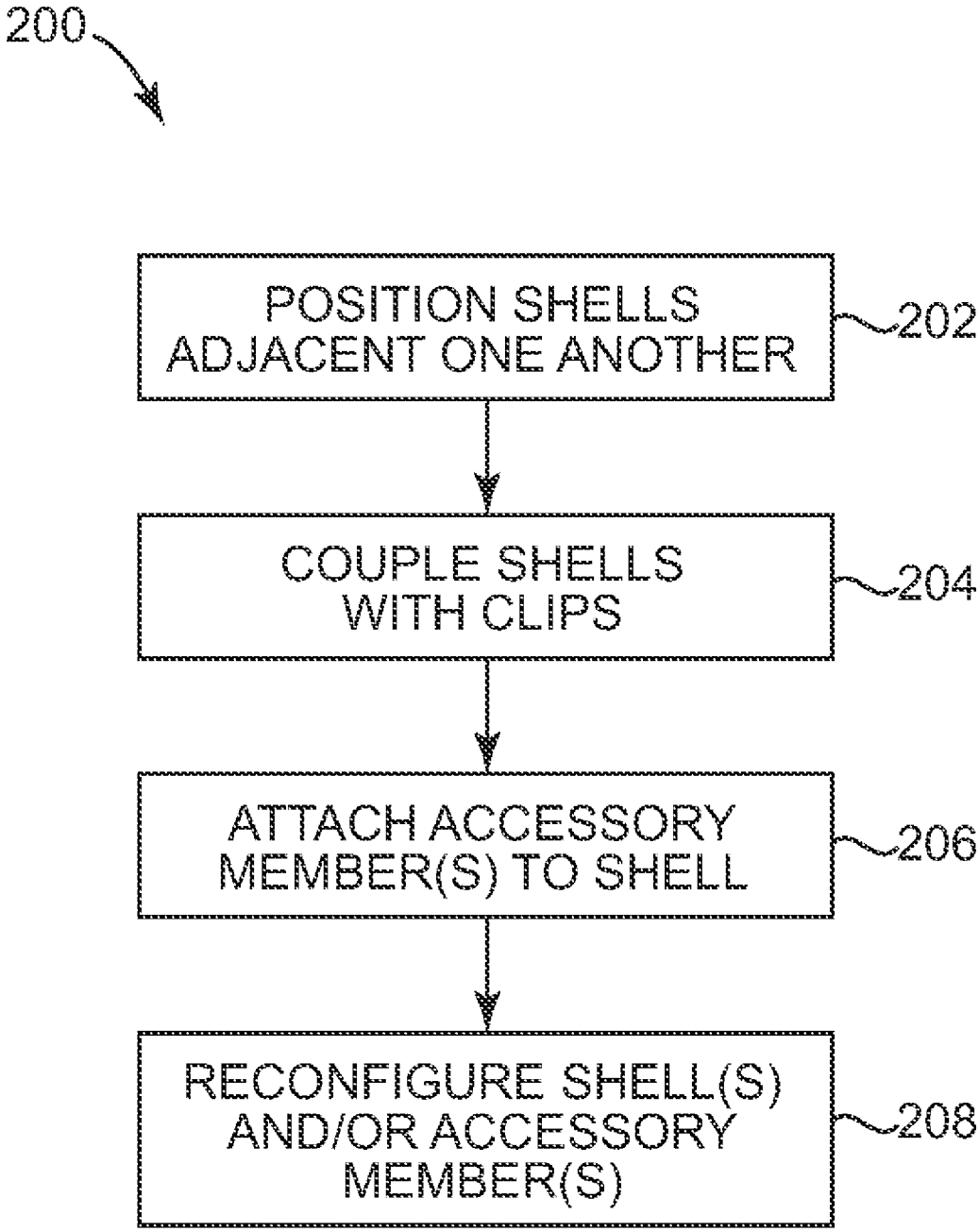
FIG. 15 illustrates a flow chart for a method of assembling a storage and organization system, according to one embodiment of the present invention.

FIG. 15 is a flow chart generally illustrating one embodiment of a method 200 of using storage and organization system 12 as described with respect to FIGS. 1 and 9. At 202, two or more storage shells 10 are positioned adjacent one another. For example, storage shells 10 are stacked or otherwise positioned next to one another. Once storage shells 10 are configured as desired at 202, then at 204, storage shells 10 are coupled to one another with clips 14 as described above. For example, where two storage shells 10 are stacked, clips 14 are positioned to extend through bottom sidewall 20*c* of one storage shell 10 and through top sidewall 20*a* of the other storage shell 10. In one example, where two storage shells 10 are positioned side by side, clips 14 are positioned through a right sidewall 20*b* of one storage shell 10 and through a left sidewall 20*d* of the other storage shell 10.

At 206, accessory member(s) 110 if any, are added to storage and organization system 12. For example, tray 112 may be placed on a storage shell 10 such that ribs 118 of tray 112 interact with track 46, support base 130 may be coupled with a bottom sidewall 20*c* of a storage shell 10, drawer unit 150 may be positioned within compartment 26 and coupled with storage shell 10, and/or any other accessory member(s) 110 may be added to personalize and/or customize the storage and organizational system for a particular purpose or need of the user. If such user purposes or needs ever change, then at 208 the user may reconfigure storage shell(s) 10 and any accessory members 110 to repurpose the storage and organization system in view of the new or changing needs of the user. Operation 208 is facilitated by use of clips 14 and other attachments that are selective and easy to be removed without damaging individual components of the storage and organization system 12 and generally do not require the use of tools.

Figure 16:
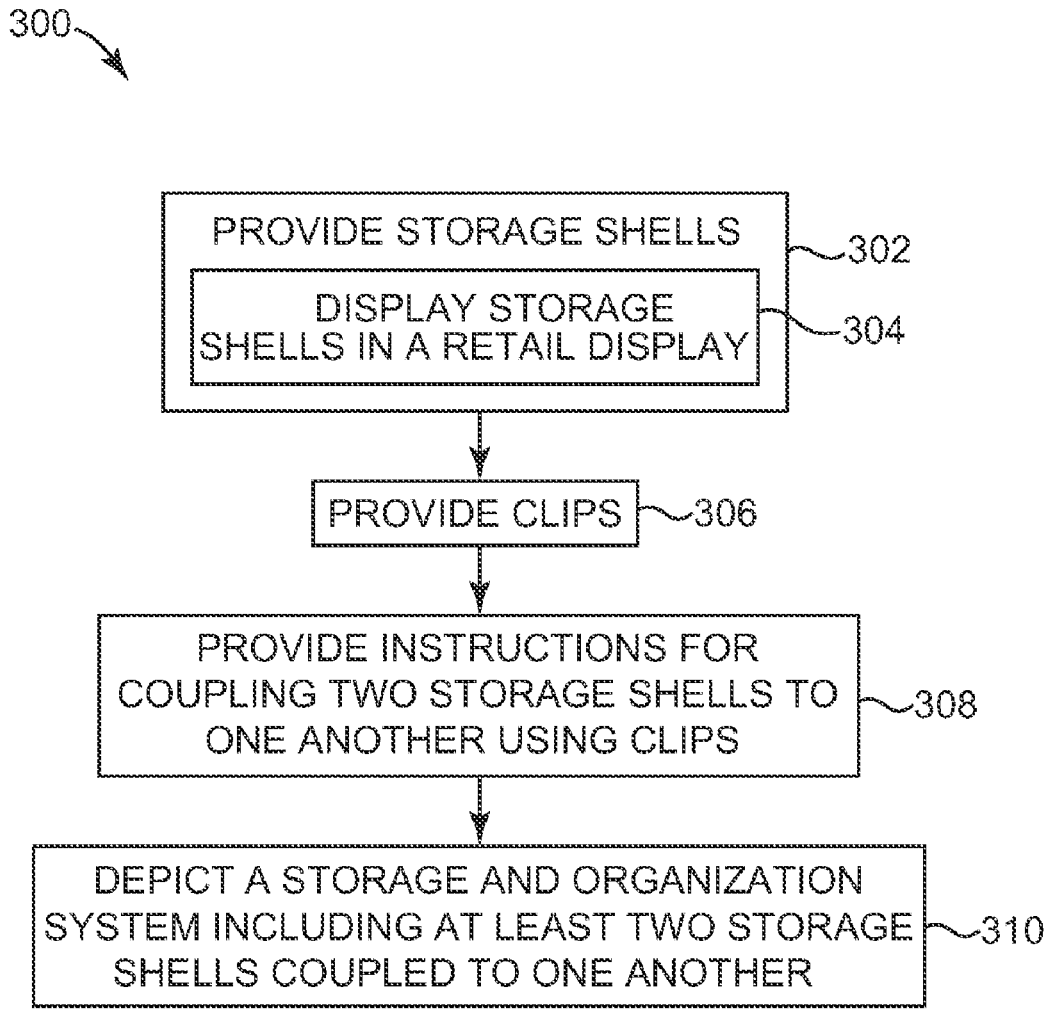
FIG. 16 illustrates a flow chart for a method of providing a storage and organization system, according to one embodiment of the present invention.

FIG. 16 illustrates one embodiment of a method 300 of providing a storage and organization system. For example, at 302, storage shells 10, for example, first storage shell 10*a*, second storage shell 10*b*, third storage shell 10*c*, etc., are provided. In one embodiment, providing storage shells 10 at 302 includes displaying storage shells 10 as part of a retail display viewable by potential consumers at 304. At 306, clips 14, and, in one example, other accessory members 110, are also provided and/or included as part of the retail display. At 308, instructions are provided to consumers instructing consumers regarding how to position and couple two or more storage shells 10 together using clips 308 and without using separate tools. For example, instructions indicate that two storage shells 10 should be placed adjacent to one another such that at least a portion of flanges 64 of each storage shell 10 interact with one another. Instructions further describe placing a clip 14 through a hole 60 in one storage shell 10 through an aligned hole 60 of another storage shell 10, etc. as described in greater detail above.

In one example, at 310, a storage and organization system, for example, storage and organization system 12 (FIG. 9), is depicted to consumers. The depiction provided at 310 not only serves as an example of how two or more storage shells 10 may be used together, but also provides inspiration to potential consumer regarding possible uses of storage shells 10. In one embodiment, by promoting different uses of storage shells 10, depiction promotes sale of storage shells 10 to consumers. In one example, the depiction provided at 310 is provided as part of or near the retail display providing storage shells 10.

It should be understood that "retail display" as used above generally refers to any tangible (e.g., in-store) or intangible (e.g., Internet-based) display of storage shells 10, etc. to potential consumers. Although method 300 is illustrated as a series of operations, in one embodiment, operations 302, 306, 308, and 310 can be performed in any order and/or two or more of operations 302, 306, 308, and 310 can be performed simultaneously as will be apparent to those of skill in the art upon reading this application.

Although the invention has been described to particular embodiments, such embodiments are for illustrative purposes only and should not be considered to limit the invention. Various alternatives and modifications within the scope of the invention in its various embodiments will be apparent to those with ordinary skill in the art upon reading this application.

What is claimed is:

1. A storage shell comprising:

a plurality of sidewalls each extending between two others of the plurality of sidewalls to collectively define a chamber therebetween, the plurality of sidewalls including a first sidewall defining:

a substantially planar panel defining an outer perimeter edge, an exterior surface, and a plurality of holes extending through the substantially planar panel and positioned near the outer perimeter edge, and a track coupled to the substantially planar panel, the track comprising:

a first rib positioned just inside and spaced from the outer perimeter edge of the substantially planar panel, the first rib extending from the exterior surface in a first direction away from the chamber, and a second rib concentric with and shaped similarly to the first rib and positioned further away from the outer perimeter edge than the first rib, the second rib extending from the exterior surface in the first direction away from the chamber, wherein the first rib borders each one of the plurality of holes, and the second rib separately borders each one of the plurality of holes, wherein each of the plurality of holes is formed between the first rib and the second rib.

2. The storage shell of claim 1, wherein the first rib and the second rib are each shaped substantially identically to, but sized smaller than, the outer perimeter edge of the substantially planar panel.

3. The storage shell of claim 1, wherein the storage shell is formed as a single contiguous piece of material.

4. The storage shell of claim 1, where the first rib and the second rib are each closed-loop in shape.

5. The storage shell of claim 1, in combination with a clip defining a head and two opposing legs, wherein the two opposing legs are configured to flex toward one another to allow the two opposing legs to pass through one of the plurality of holes in the substantially planar panel, and wherein the two opposing legs only fit through the one of the plurality of holes when the two opposing legs are flexed toward one another.

6. The storage shell of claim 5, wherein the clip is configured to be locked in place relative to and subsequently removed from the substantially planar panel without use of separate tools.

7. The storage shell of claim 1, wherein each of the plurality of sidewalls is substantially identical to the first sidewall.

8. The storage shell of claim 1, further comprising flanges each radially extending away from an intersection line defined along the outer perimeter edge of the substantially planar panel, wherein each of the flanges extends from the first sidewall with an angle between about 30° and about 60°.

9. The storage shell of claim 8, wherein the storage shell is a first storage shell and is provided in combination with a second storage shell, the second storage shell is substantially identical to the first storage shell and comprises:

a plurality of sidewalls including a first sidewall of the second storage shell, and flanges of the second storage shell, wherein the first storage shell and the second storage shell are positioned adjacent one another such that the flanges of the first storage shell interface with the flanges of the second storage shell in a manner maintaining the first sidewall of the first storage shell spaced from and substantially parallel to the first sidewall of the second storage shell.

10. The combination of claim 9, further comprising:

a clip extending between the first sidewall of the first storage shell and the first sidewall of the second storage shell, the clip being substantially unsupported between the first sidewall of the first storage shell and the first sidewall of the second storage shell for at least half a length of the clip;

wherein the first storage shell and the second storage shell only directly contact one another along an interface between the flanges of the first storage shell and the flanges of the second storage shell.

11. The combination of claim 10, wherein the clip comprises:

a head defining a substantially planar surface and an outer diameter, the outer diameter being larger than an outer dimension of one of the plurality of holes of the first storage shell;

a pair of legs extending from the substantially planar surface of the head to define free ends opposite the substantially planar surface, wherein the free ends are configured to flex toward one another into a flexed position when corresponding forces are applied to the free ends and to return to an original position upon removal of the corresponding forces, the free ends define two claws each extending outwardly from a different one of the free ends of the pair of legs, the two claws collectively being wider than the outer dimension of the one of the plurality of holes of the first storage shell when the clip is in the original position, and the two claws are collectively narrower than the outer dimension of the one of the plurality of holes when the clip is in the flexed position.

12. The storage shell of claim 1, in combination with a support base comprising:

a planar member defining four corners, four separate support legs extending from one side of the planar member from each of the four corners of the planar member; and pillars each extending from an opposite side of the planar member in an opposite direction as the four separate support legs, wherein each pillar fits within one of the plurality of holes defined by the first sidewall.

13. The combination of claim 12, wherein each of the pillars is tapered as it extends away from the planar member.

14. The storage shell of claim 1, in combination with a tray defining a substantially planar bottom panel and at least two rails extending downwardly from the substantially planar bottom panel, wherein each of the at least two rails is selectively positioned adjacent to and within a corner of the track when the tray is placed on the first sidewall.

15. A storage and organization system comprising:

a first box comprising:

four first side panels coupled to one another to collectively define a first compartment therebetween, wherein a first aperture is defined by each of the first side panels, and first flanges each extending away from a first intersection line defined along an outside perimeter length of each of the first side panels;

a second box comprising:

four second side panels coupled to one another to collectively define a second compartment therebetween, wherein a second aperture is defined by each of the second side panels, and second flanges each extending away from a second intersection line defined along an outside perimeter length of each of the second side panels, wherein:

the first and second boxes are positioned adjacent one another such that two or more of the first flanges contact two or more of the second flanges, one of the first side panels is adjacent each of two or more of the first flanges, one of the second side panels is adjacent each of the two or more of the second flanges, and the one of the first side panels is spaced from and extends generally parallel to the one of the second side panels to define a cavity therebetween; and a connecting device extending through the first aperture and the second aperture to couple the first box to the second box, wherein:

the connecting device independently extends through the cavity defined between the one of the first side panels and the one of the second side panels, the connecting device is one of a plurality of substantially identical connecting devices extending between the one of the first side panels and the one of the second side panels, and the plurality of substantially identical connecting devices are the only items extending between and contacting the one of the first side panels and the one of the second side panels within the cavity.

16. The storage and organization system of claim 15, wherein each of the first flanges radially extends outwardly away from a center of the first box, and each of the second flanges radially extends outwardly away from a center of the second box.

17. The storage and organization system of claim 15, wherein the first side panels each include a track defined by a pair of ribs shaped substantially identically to and slightly offset from an outside perimeter of first side panel.

18. The storage and organization system of claim 15, wherein the connecting device comprises:

a head having an outer dimension larger than the first aperture and defining a substantially planar surface;

a pair of legs extending away from the substantially planar surface of the head, the pair of legs extending spaced from and substantially parallel to one another and extending substantially perpendicularly relative the substantially planar surface of the head, wherein the pair of legs are configured to flex toward one another to allow the pair of legs to pass through the first aperture and the second aperture, and wherein the pair of legs only fit through the first aperture and the second aperture when the pair of legs are flexed toward one another.

19. The storage and organization system of claim 15, wherein one of the first side panels faces the second box, the one of the first side panels is substantially planar, defines an exterior surface, and the first aperture is one of a plurality of first apertures defined by and extending through the one of the first side panels and is positioned near an outside perimeter of the one of the first side panels, and the first box further comprises:

a track coupled to the one of the first side panels, the track comprising:

a first rib positioned just inside and spaced from the outside perimeter of the one of the first side panels, the first rib extending from the exterior surface in a first direction away from the first compartment, and a second rib concentric with and shaped substantially identically to the first rib and positioned further away from the outside perimeter of the one of the first side panels than the first rib, the second rib extending from the exterior surface in the first direction away from the first compartment, wherein the first rib borders each of the plurality of first apertures defined by the one of the first side panels, and the second rib separately borders each of the plurality of first apertures, wherein each of the plurality of first apertures of the one of the first side panels is formed between the first rib and the second rib.

20. The storage and organization system of claim 15, wherein the first and second boxes only contact each other via the two or more of the first flanges and the two or more of the second flanges.

21. The storage and organization system of claim 15, wherein each of the plurality of substantially identical connecting devices extends substantially unsupported between the one of the first side panels and the one of the second side panels.

* * * * *